US005087149A

United States Patent [19]

Waller, Jr.

[11] Patent Number: 5,087,149

[45] Date of Patent: Feb. 11, 1992

[54] INTERLOCKING WOODEN MAT ROADWAY

[76] Inventor: A. J. Waller, Jr., P.O. Box 1591, Nederland, Tex. 77627

[21] Appl. No.: 337,880

[22] Filed: Apr. 14, 1989

[51] Int. Cl.[5] ..... E01C 5/14; E01C 9/08

[52] U.S. Cl. ..... 404/35; 404/46; 52/177

[58] Field of Search ..... 404/35, 36, 40, 41, 404/46; 52/125.2, 177, 314, 342, 581, 592, 593

[56] References Cited

U.S. PATENT DOCUMENTS

| | | | |
|---|---|---|---|
| 70,514 | 5/1867 | Brown | 404/46 |
| 152,299 | 6/1874 | McCauley | 404/46 |
| 2,639,650 | 5/1953 | Robinshaw | 404/35 |
| 2,652,753 | 9/1953 | Smith | 52/581 |
| 2,819,026 | 1/1958 | Leyerndecker | 404/41 |
| 2,912,909 | 11/1959 | Hart | 404/36 |
| 3,703,059 | 11/1972 | Kessler | 52/581 |
| 3,964,221 | 6/1976 | Berquist | 52/592 |
| 3,990,197 | 11/1976 | Johnston | 52/125.2 |
| 4,016,692 | 4/1977 | Jordan et al. | 52/314 |
| 4,289,420 | 9/1981 | Davis et al. | 404/35 |
| 4,462,712 | 7/1984 | Penland, Sr. | 404/46 |
| 4,600,336 | 7/1986 | Walter, Jr. | 404/46 |
| 4,600,337 | 7/1986 | Sarver | 404/46 |

FOREIGN PATENT DOCUMENTS

| | | | |
|---|---|---|---|
| 1087602 | 4/1984 | U.S.S.R. | 404/16 |
| 1198139 | 12/1985 | U.S.S.R. | 404/35 |

*Primary Examiner*—William P. Neuder

*Attorney, Agent, or Firm*—Neal J. Mosely

[57] ABSTRACT

An interlocking wooden mat assembly for roadways in undeveloped areas comprises a three layered lamination of substantially parallel and closely spaced wooden planks forming each layer, which assemblies are rectangular and interlock along one of the longer sides. Selected planks of the bottom layer are offset longitudinally and extend beyond the intermediate layer at one end to provide a male extension on one end and a female recess at the other end. The planks of the bottom layer lie parallel to each other along the shorter dimension of the rectangular mat. The planks of the intermediate lie parallel to each other along the longer dimension of the rectangular mat and terminate at the edges of the rectangle. The top layer has planks extending parallel to each other and to the bottom planks along the shorter dimension of the rectangle comprising two groups of planks spaced toward the edges of the rectangle with the intermediate portion of the intermediate layer of planks being uncovered. The two groups of planks in the top layer are separated sufficiently to provide spaced tracks for the tires of a truck of other motor vehicle riding thereon, each group having a centrally located space wide enough to receive another plank of the same size. Extra planks are secured in those centrally located spaced and overlapping adjacent mat assemblies to secure such assemblies together as a roadway. Each mat assembly may have loops of cable for lifting and transporting.

18 Claims, 4 Drawing Sheets

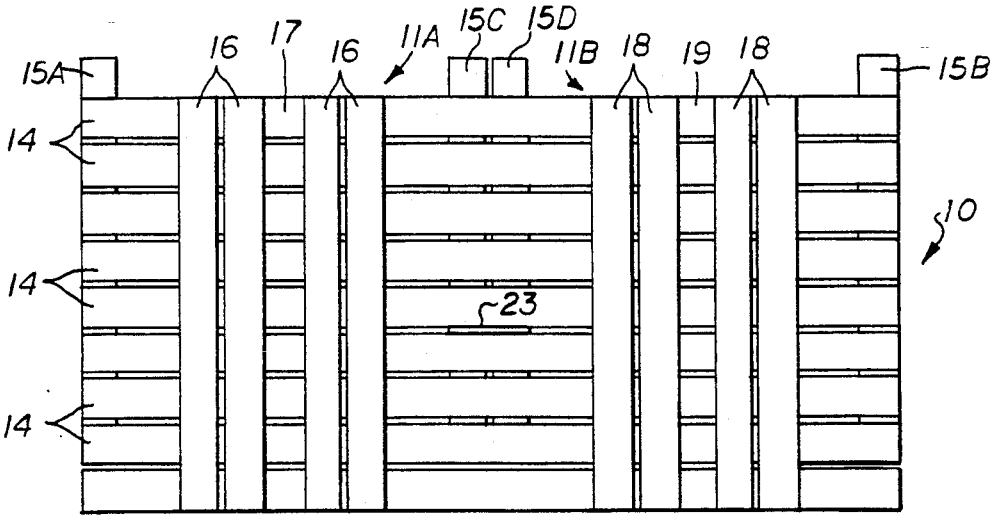
FIG. 1
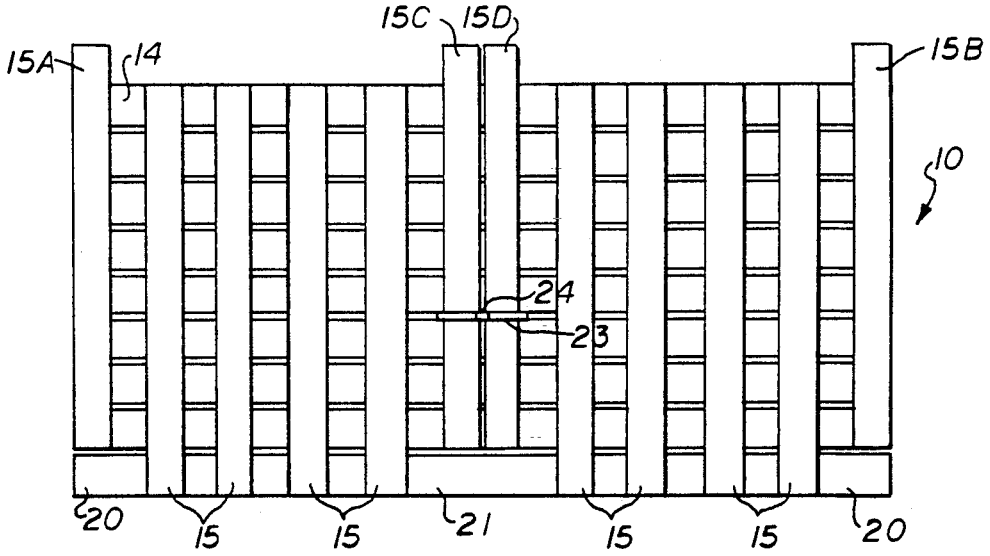
FIG. 2
FIG. 3
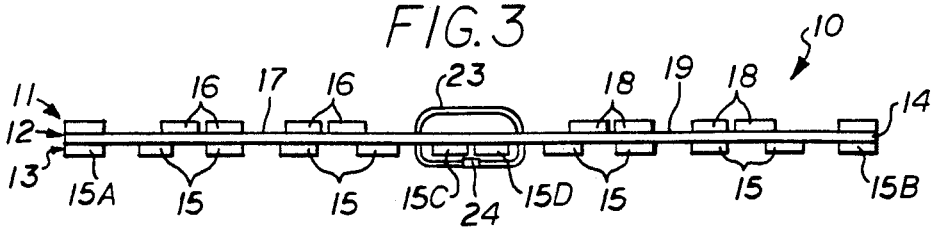

INTERLOCKING WOODEN MAT ROADWAY

BACKGROUND OF THE INVENTION

1. Field of the Invention

This invention relates to temporary roadways, and more particularly to reusable wooden mat units which can be easily transported and interlocked with other to form a strong wooden roadway for undeveloped areas.

2. Brief Description of the Prior Art

Wooden mats are known in the art for use in highway and construction sites. There are several patents which disclose various wooden mat constructions.

Brown, U.S. Pat. No. 70,514 discloses a wood pavement construction formed of embedded foundation timers in an arch shape from curb to curb which support plurality of interlocking wooden blocks.

McCauley, U.S. Pat. No. 152,299 discloses a wood pavement formed of a series of spaced apart lateral and longitudinal stringers with sand fill packed between and which support a plurality of wooden pavement blocks.

Smith, U.S. Pat. No. 2,652,753 discloses an intermeshing matting comprising parallel upper and lower runners connected to a series of parallel transverse members disposed therebetween. The ends of each adjacent pair of upper runners are staggered to terminate intermediate the width of the end transverse member or terminate beyond the end transverse member. The ends of each adjacent pair of lower runners is staggered opposite to the runners above them. Modifications include a pattern of staggering every other runner, or a single runner and an adjacent pair. There is no provision for interlocking the units in a side by side arrangement, and the disclosure suggests that in most case it is not necessary to positively connect the sections together, as the friction of interfitting is allegedly sufficient for this purpose.

Leyendecker U.S. Pat. No. 2,819,026 discloses two-ply wooden mats which interlock only in end-to-end relation.

Davis, et al, U.S. Pat. No. 4,289,420 discloses a wooden mat comprising a surface layer of longitudinal top wooden planks, an intermediate layer of transverse planks more widely spaced, and an underlying layer of longitudinal bottom planks. A short stabilizing plank is mounted transversely at the end of the longitudinal bottom planks. The ends of the top layer are alternately staggered in a manner to provide alternate longitudinally staggered lap joints for interconnecting the ends of a like mat. The ends of the intermediate transverse planks extend outward the same distance on one side, such that the rotating one mat through 180 degrees and interlocking the extended ends, the sections may be interlocked side by side. To disassemble such an interlocking system once connected, it becomes necessary to dismantle almost one entire section to remove one section from another.

Penland U.S. Pat. No. 4,462,712 discloses an interlocking mat assembly comprising a plurality of assemblies of two-ply laminated mats which interlock and are secured together by nailing a top layer of planks over the interlocked mats. This mat assembly has the disadvantage of higher labor costs in assembly and disassembly.

Waller U.S. Pat. No. 4,600,336 discloses a wooden mat assembly of three-ply construction designed to interlock along the top and intermediate layers along the ends and edges. The orientation of the planks and mode of interlocking is primarily for platforms rather than roadways and no provision is made for spaced tracks for vehicles on the top layer when used as a roadway.

The prior art in general, and none of these patents in particular, disclose a reusable interlocking wooden mat assembly having lifting and transporting means and novel interlocking construction with spaced tracks for vehicles when assembled as a roadway.

SUMMARY OF THE INVENTION

It is often necessary during the exploration, establishment, and servicing of oil field drilling sites to transport heavy equipment and vehicles into remote isolated areas over very primitive terrain and ground conditions.

Typical areas would have no roads and may be swamp land, mud fields, or sand fields. It is very costly if vehicles become bogged down, are unable to reach the site, or inadequate terrain exists for storage of heavy equipment.

It is therefore an object of the present invention to provide a wooden mat section for construction of temporary roadways and storage areas in remote undeveloped locations, such as oil fields and the like.

Another object of this invention is to provide a wooden mat section having a convenient lifting means for lifting and transporting and handling the sections with conventional equipment.

Another object of this invention is to provide reusable wooden mat sections which are easily transported and interlocked with other like sections and may be quickly removed and transported to another location.

Another object of this invention is to provide reusable wooden mat sections, having spaced tracks on the surface layer for vehicles, which are easily transported and interlocked with other like sections and may be quickly removed and transported to another location.

Another object of this invention is to provide a wooden mat section which may be interlocked with other like sections in an edge to edge configuration.

Other objects of the invention will become apparent from time to time throughout the specification and claims are hereinafter related.

The above noted objects and other objects of the invention are accomplished by an interlocking wooden mat assembly for roadways in undeveloped areas which comprises a three layered lamination of substantially parallel and closely spaced wooden planks forming each layer, which assemblies are rectangular and interlock along one of the longer sides. Selected planks of the bottom layer are offset longitudinally and extend beyond the intermediate layer at one end to provide a male extension on one end and a female recess at the other end. The planks of the bottom layer lie parallel to each other along the shorter dimension of the rectangular mat. The planks of the intermediate lie parallel to each other along the longer dimension of the rectangular mat and terminate at the edges of the rectangle. The top layer has planks extending parallel to each other and to the bottom planks along the shorter dimension of the rectangle comprising two groups of planks spaced toward the edges of the rectangle with the intermediate portion of the intermediate layer of planks being uncovered. The two groups of planks in the top layer are separated sufficiently to provide spaced tracks for the tires of a truck of other motor vehicle riding thereon, each group having a centrally located space wide enough to receive another plank of the same size. Extra planks are secured in those centrally located spaced and overlapping adjacent mat assemblies to secure such assemblies together as a roadway. Each mat assembly may have loops of cable for lifting and transporting.

BRIEF DESCRIPTION OF THE DRAWINGS

FIG. 1 is a top plan view of one embodiment of an interlocking wooden mat for construction of temporary roadways.

FIG. 2 is a bottom plan view of the wooden mat shown in FIG. 1 showing the offset planks in the bottom layer of the mat.

FIG. 3 is a view in end elevation of the wooden mat of FIG. 1 showing the relation of the planks in the top, intermediate and bottom layers and showing a loop of cable for lifting.

DESCRIPTION OF THE PREFERRED EMBODIMENTS

Figure 4:
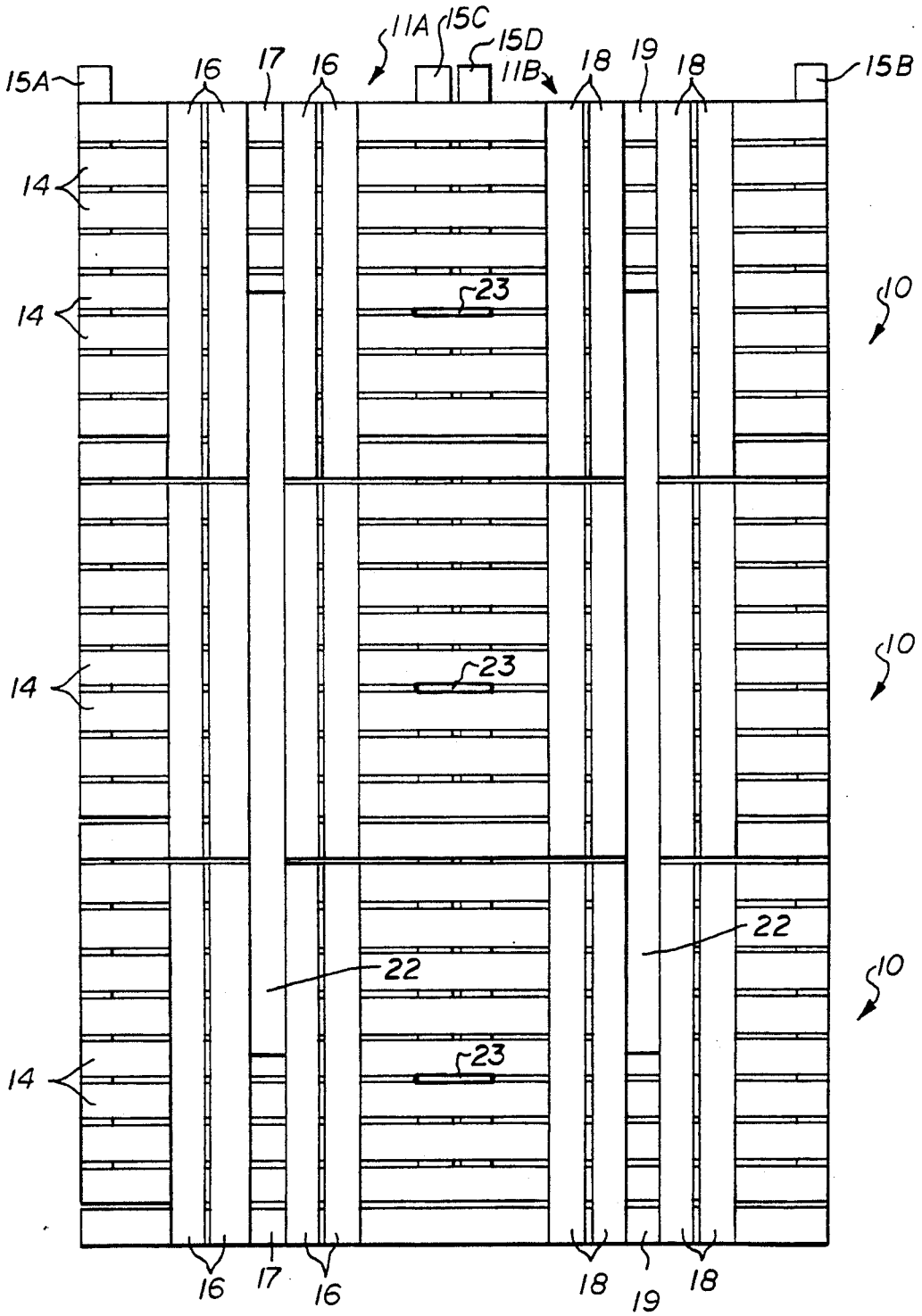
FIG. 4 is a top plan view of a plurality of the interlocking mats, as shown in FIG. 1, interconnected to provide a roadway.

Referring to the drawings by numerals of reference, and more particularly to FIGS. 1-3, there is shown a single assembled interlocking mat 10 of rectangular shape. Mat 10 is three-ply laminate of planks of suitable material such as road grade lumber joined together by nails (not shown). Mat 10 has a top layer 11 comprising substantially parallel wooden planks extending along the shorter dimension of the rectangle; intermediate layer 12 comprising substantially parallel planks extending along the longer dimension of the rectangle, and bottom layer 13 comprising substantially parallel planks extending along the shorter dimension of the rectangle.

The long dimension of mat 10 of FIG. 1 is preferably twice the width so that the mats 10 can be interconnected with like sections edge to edge, end to edge, or end to end. One commercially designed mat is approximately 8'×16', although 8'×12' mats are usable in some installations. The mats are designed to be interconnected along the longer edge of the rectangle.

The intermediate layer 12 comprises a plurality of closely spaced parallel planks 14 extending along the longer dimension of the rectangle and terminating at the edges thereof. The bottom layer 13 comprises a plurality of spaced parallel planks 15 extending at right angles to and nailed to planks 14 of the intermediate layer 12. Top layer 11 has two portions 11*a* and 11*b* spaced apart by a distance "A" sufficient to define a track for the wheels of a motor vehicle, i.e., spaced by about the lateral distance between the wheels of a truck.

The top layer portions 11*a* and 11*b* comprise planks extending at right angles to and nailed to planks 14 of the intermediate layer 12. Top layer portion 11*a* comprises a plurality of planks 16 with a space 17 positioned to receive a tie-in plank to be installed at the time of assembly. Top layer portion 11*b* comprises a plurality of planks 18 with a space 19 positioned to receive a tie-in plank to be installed at the time of assembly. The lateral distance from side-to-side across planks 16 and across planks 18 is sufficient to define a track of sufficient width for the wheels of a motor vehicle to roll on.

The outermost bottom planks 15*a* and 15*b*, and the centrally located bottom planks 15*c* and 15*d*, are offset longitudinally to extend beyond the intermediate layer 12 the distance of the width of one transverse plank 14 at one end and to leave exposed areas, or female recesses 20 and 21 of the same dimension at the other end. The extended male ends of the planks 15*a*, 15*b*, 15*c* and 15*d* of one mat section 10 will fit into the exposed areas, or female recesses 20 and 21 of an adjacent mat when interconnecting edge-to-edge in laying a roadway with top planks 16 and 18 defining a track for vehicles thereon. A longitudinal tie-in plank 22 (FIG. 4) is provided with each assembly for securely interlocking like sections together as described hereinafter.

At least one cable loop 23 is provided at approximately the center of gravity of mat 10 for lifting and transporting the mat by a forklift or other suitable handling means. Cable 23 is looped around the appropriate longitudinal planks 15*c* and 15*d*, and the ends securely joined by suitable means such as a cable connector 24 (FIG. 3). Cable loop 23 extends above the mat 10 a sufficient distance to permit a fork-lift or other lifting device to be inserted to lift and move the mats 10 to position.

The installation and assembly of the mats into a roadway is quite simple. A portion of such a roadway is shown in FIG. 4. One of the mats 10 is lifted by a fork lift inserted into cable loop 23 and moved into position. Next, another of the mats 10 is lifted by a fork lift inserted into cable loop 23 and moved to a location adjacent to the first mat 10 and lowered into position with recesses 20 and 21 in the bottom layer 13 of planks fitting over the projecting ends of planks 15*a*, 15*b*, 15*c* and 15*d*. The plank 14 of intermediate layer 12 overlying the projecting ends of planks 15*a*, 15*b*, 15*c* and 15*d* is nailed to those plank ends to secure mats 10 together along their long dimension. Planks 22 are then installed in longitudinal spaces 17 and 19 and nailed to the planks of intermediate layer 12. Planks 22 are preferably the length of twice the smaller dimension of mats 10 and installed so that the planks overlie one mat and project half way into each adjacent mat. Planks 22 of shorter length can be used so long as they overlap adjacent mats to secure them together. It should be noted that the construction of mats 10 allows them to be dropped into place ahead of the forklift and provide a road bed which supports the forklift as it moves ahead into the undeveloped region where the roadway is being installed.

Figure 5:
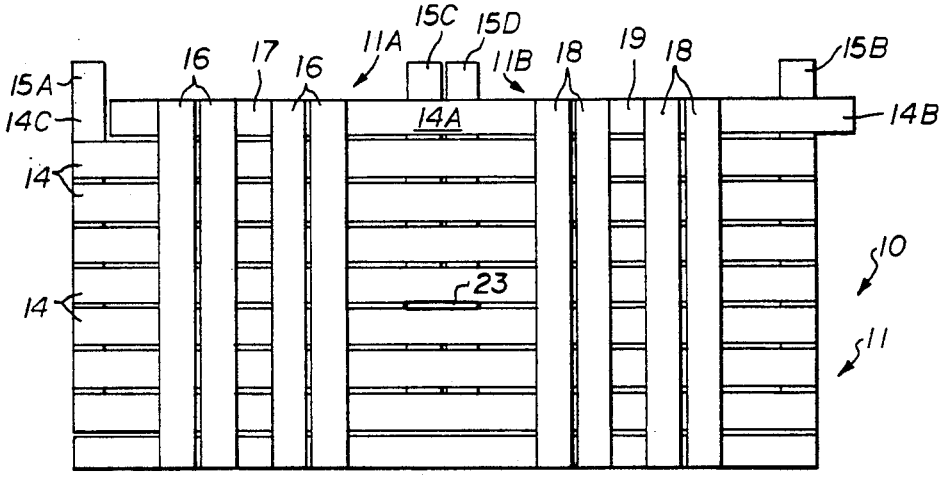
FIG. 5 is a top plan view of another embodiment of an interlocking wooden mat as shown in FIG. 1, having an offset plank in the intermediate layer to facilitate side-to-side assembly for construction of double wide temporary roadways.

In FIG. 5, there is shown a slightly modified embodiment of an assembled interlocking mat 10 of rectangular shape. This embodiment of mat 10 is three-ply laminate of planks of suitable material such as road grade lumber joined together by nails (not shown). This embodiment of mat 10 has a top layer 11 comprising substantially parallel wooden planks extending along the shorter dimension of the rectangle; intermediate layer 12 comprising substantially parallel planks extending along the longer dimension of the rectangle, and bottom layer 13 comprising substantially parallel planks extending along the shorter dimension of the rectangle.

The long dimension of mat 10 of FIG. 5 is preferably twice the width so that the mats 10 can be interconnected with like sections edge to edge, end to edge, or end to end. One commercially designed mat is approximately 8'×16', although 8'×12' mats are usable in some installations. The mats are designed to be interconnected along the longer edge of the rectangle but have a provision for side-to-side installation as will be described below.

The intermediate layer 12 of this embodiment comprises a plurality of closely spaced parallel planks 14 extending along the longer dimension of the rectangle and terminating at the edges thereof. The bottom layer 13 comprises a plurality of spaced parallel planks 15 extending at right angles to and nailed to planks 14 of the intermediate layer 12. Top layer 11 has two portions 11*a* and 11*b* spaced apart by a distance "A" sufficient to define a track for the wheels of a motor vehicle, i.e., spaced by about the lateral distance between the wheels of a truck.

The top layer portions 11*a* and 11*b* comprise planks extending at right angles to and nailed to planks 14 of the intermediate layer 12. Top layer portion 11*a* comprises a plurality of planks 16 with a space 17 positioned to receive a tie-in plank to be installed at the time of assembly. Top layer portion 11*b* comprises a plurality of planks 18 with a space 19 positioned to receive a tie-in plank to be installed at the time of assembly. The lateral distance from side-to-side across planks 16 and across planks 18 is sufficient to define a track of sufficient width for the wheels of a motor vehicle to roll on.

Figure 6:
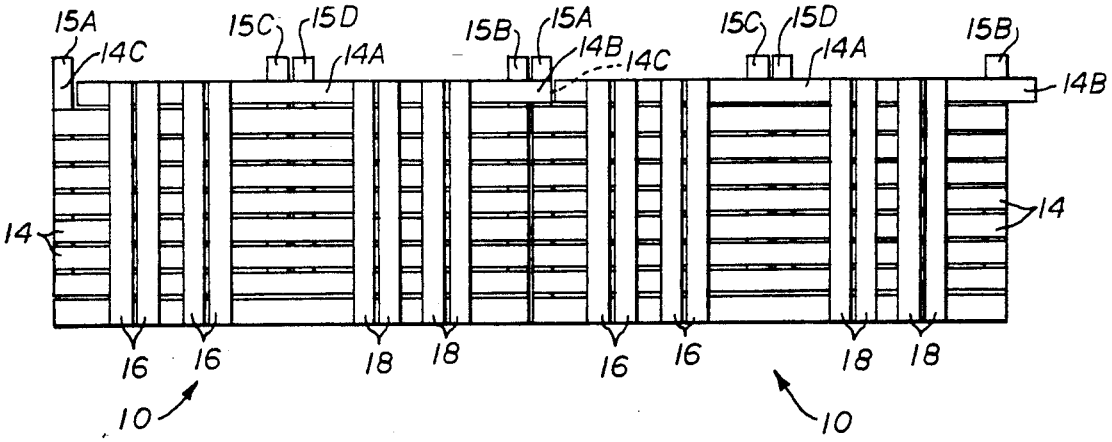
FIG. 6 is a top plan view of two of the interlocking mats, as shown in FIG. 5, interconnected side-to-side to provide a double wide roadway.
Figure 7:
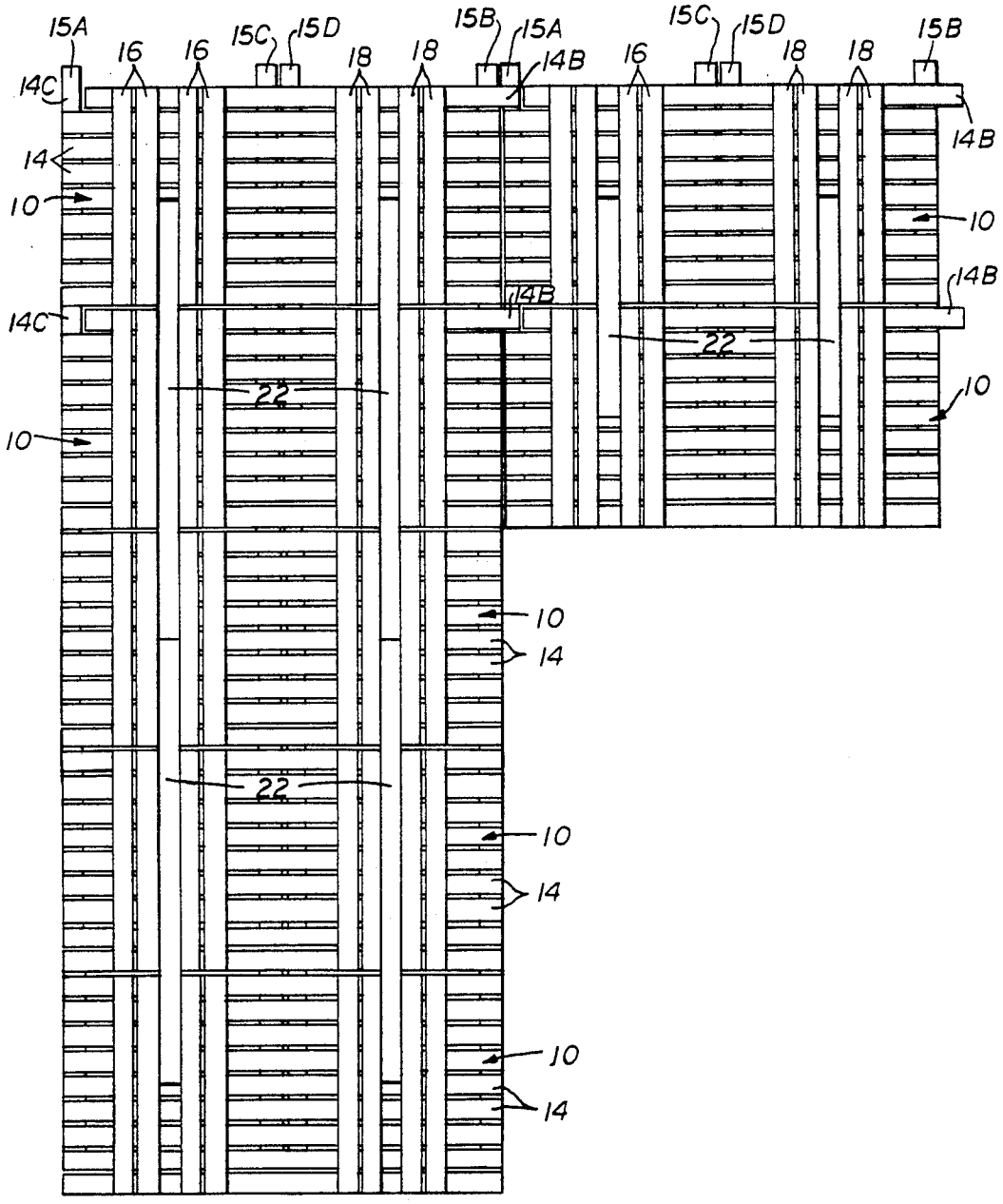
FIG. 7 is a top plan view of a plurality of the interlocking mats, as shown in FIG. 5, interconnected end-to-end and side-to-side to provide a turn in a roadway or a turnaround.

The outermost bottom planks 15*a* and 15*b*, and the centrally located bottom planks 15*c* and 15*d*, are offset longitudinally to extend beyond the intermediate layer 12 the distance of the width of one transverse plank 14 at one end and to leave exposed areas, or female recesses 20 and 21 of the same dimension at the other end. The extended male ends of the planks 15*a*, 15*b*, 15*c* and 15*d* of one mat section 10 will fit into the exposed areas, or female recesses 20 and 21 of an adjacent mat when interconnecting edge-to-edge in laying a roadway with top planks 16 and 18 defining a track for vehicles thereon. A longitudinal tie-in plank 22 (FIG. 7) is provided with each assembly for securely interlocking like sections together as described hereinafter. the intermediate layer 12 of planks fitting under the projecting end 14*b* of plank 14*a*. The projecting end 14*b* of plank 14*a* of intermediate layer 12 overlying plank 15*a* is nailed to that plank to secure mats 10 together along their shorter dimension as shown in FIG. 6. Additional mats 10 of this embodiment are then installed along their longer dimensions as in FIG. 4 and the side-to-side installation continued as in FIG. 6 to produce roadway of double width. In FIG. 7, this construction is illustrated as applied to a turn in the roadway or a turn-around.

As the longitudinal construction of the road way continues, planks 22 are installed in longitudinal spaces 17 and 19 and nailed to the planks of intermediate layer 12. Planks 22 are preferably the length of twice the smaller dimension of mats 10 and installed so that the planks overlie one mat and project half way into each adjacent mat. Planks 22 of shorter length can be used so long as they overlap adjacent mats to secure them together.

In both of the described embodiments, the planks are nailed together to form the individual mats 10 and the projecting male ends are nailed to the planks underlying the female recesses into which they are fitted. The nailing of the planks is as in Waller U.S. Pat. No. 4,600,336. The mat assemblies can be separate easily by removing the tie-in planks 22 joining the mat sections and removing the nails joining the mats at the extended male ends 14*b*, 15*a*, 15*b*, 15*c* and 15*d*, respectively. The separated mat sections may then be lifted and transported to another location where they may be reused. The tie-in board 22 could be supplied in various lengths to accommodate various tie-in configurations of mat assemblies.

While this invention has been described fully and completely with special emphasis upon a preferred embodiment, it should be understood that within the scope of the appended claims the invention may be practiced otherwise than as specifically described herein.

1. A laminated wooden mat section of at least three ply construction adapted to be secured in interlocking relation to other like mat sections for constructing roadways in underdeveloped areas to be driven upon by the wheels of a motor vehicle, said mat section being of rectangular shape with a shorter side and a longer side at least 50% longer than said shorter side and comprising an intermediate layer of closely spaced planks of predetermined width and of substantially equal length extending parallel to each other for the length of the longer side of said rectangular shape from one edge to the other thereof, a bottom layer of substantially parallel wooden planks of predetermined width and of substantially equal length corresponding to the length of the shorter side of said rectangular shape, secured to said intermediate layer of planks at right angles thereto by nailing, with the ends thereof secured to the outermost planks of said intermediate layer to define said rectangular shape, at least one plank of said bottom layer being longitudinally offset to provide a male extension at only one end and a female recess only at the other end of said bottom layer, a top layer of substantially parallel wooden planks of predetermined width and of substantially equal length corresponding to the length of the shorter side of said rectangular shape, secured to said intermediate layer of planks at right angles thereto by nailing, said top layer comprising two groups of closely spaced planks, each group of planks being of sufficient width and spaced one group from the other a sufficient distance to provide parallel tracks for the wheels of a motor vehicle when said mat sections are assembled into a roadway, at least one of said top layer groups of planks having an internal longitudinal space of substantially the width of one of said planks, said layers being securely attached together at common overlapping intersections, and said bottom layer male extensions being adapted to fit and be removably secured in said female recess on an adjacent mat by being lowered into position for assembly along the longer edge of said rectangular shape with the edges and ends, respectively, of adjacent mats being in a straight line and said groups of top layer planks being aligned to define said parallel vehicle tracks, said mat sections being substantially lighter in weight than mats having closely spaced planks on each of the layers thereof and being constructed to permit a vehicle to move along a previously laid mat while laying the next mat in the roadway being assembled.

2. A mat section according to claim 1 in which said bottom layer of shorter planks has one plank at each end and at least one centrally disposed plank longitudinally offset to provide male extensions beyond said intermediate layer a distance of approximately the width of one of said intermediate layer planks at one end and to provide female recesses of like size at the other end.

3. A mat section according to claim 1 including a longitudinally extending tie-in plank of predetermined width adapted to be removably secured by nailing in said internal longitudinal space in one of said top layer groups of planks and having a length sufficient to fit in said internal longitudinal space in one of said top layer groups of planks on an adjacent mat section and be secured by nailing to releasably interlock adjacent mat assemblies together.

4. A mat section according to claim 1 in which said intermediate layer of longer planks has one end plank laterally offset to provide a male extension beyond the side of said rectangular shape a distance of approximately the width of one of said planks at one end and to provide a female recess of like size at the other end to permit side-to-side assembly of said mats into a double-wide roadway section.

5. A mat section according to claim 1 in which the planks of each of said layers are composed of road grade lumber.

6. A mat section according to claim 1 in which said planks are securely attached together at common overlapping intersections by nails.

7. A mat section according to claim 1 in which the longer side of said mat section is substantially twice the length of said shorter side.

8. A mat section according to claim 1 in which said bottom layer has one plank at each end and at least one centrally disposed plank longitudinally offset to provide male extensions beyond said intermediate layer a distance of approximately the width of one of said intermediate layer planks at one end and to provide female recesses of like size at the other end, and said intermediate layer has one end plank laterally offset to provide a male extension beyond the side of said rectangular shape a distance of approximately the width of one of said planks at one end and to provide a female recess of like size at the other end to permit side-to-side assembly of said mats into a double-wide roadway section.

9. A mat section according to claim 8 including a longitudinally extending tie-in plank adapted to be removably secured by nailing in said internal longitudinal space in one of said top layer groups of planks and having a length sufficient to fit in said internal longitudinal space in one of said top layer groups of planks on an adjacent mat section and be secured by nailing to releasably interlock adjacent mat assemblies together.

10. A plurality of mat sections according to claim 1 assembled with the male extensions on one fitting the corresponding female recesses on an adjacent one and nailed to the adjacent layer thereof and having longitudinally extending tie-in planks nailed in said internal longitudinal space in one of said top groups of planks to interlock adjacent mat assemblies releasably together.

11. A plurality of mat sections according to claim 4 assembled in both side-to-side and end-to-end relation with the male extensions on one fitting the corresponding female recesses on an adjacent one and nailed to the adjacent layer thereof and having longitudinally extending tie-in planks nailed in said internal longitudinal space in one of said top groups of planks to interlock adjacent mat assemblies releasably together.

12. A mat section according to claim 1 including means secured thereon for lifting and transporting the same.

13. A mat section according to claim 12 in which said lifting and transporting means comprises at least one cable loop secured adjacent to the center of gravity of said mat section around selected planks of said bottom layer.

14. A plurality of mat sections according to claim 13 assembled with the male extensions on one fitting the corresponding female recesses on an adjacent one and nailed to the underlying layer thereof and having longitudinally extending tie-in planks nailed in said internal longitudinal space in one of said top groups of planks to interlock adjacent mat assemblies releasably together.

15. A mat section according to claim 4 including means secured thereon for lifting and transporting the same.

16. A mat section according to claim 15 in which said lifting and transporting means comprises at least one cable loop secured adjacent to the center of gravity of said mat section around selected planks of said bottom layer.

17. A plurality of mat sections according to claim 16 assembled with the male extensions on one fitting the corresponding female recesses on an adjacent one and nailed to the underlying layer thereof and having longitudinally extending tie-in planks nailed in said internal longitudinal space in one of said top groups of planks to interlock adjacent mat assemblies releasably together.

18. A mat section according to claim 1 in which said shorter side is about 8 ft. and said longer side is about 12–16 ft. in length.

* * * * *